US009793638B2

(12) United States Patent
Meier et al.

(10) Patent No.: US 9,793,638 B2
(45) Date of Patent: Oct. 17, 2017

(54) PLUG CONNECTOR MODULE

(71) Applicant: HARTING Electric GmbH & Co. KG, Espelkamp (DE)

(72) Inventors: Heiko Meier, Minden (DE); Uwe Sundermeier, Espelkamp (DE); Svea Meier, Minden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/906,458

(22) PCT Filed: Jun. 23, 2015

(86) PCT No.: PCT/DE2015/100253
§ 371 (c)(1),
(2) Date: Jan. 20, 2016

(87) PCT Pub. No.: WO2015/197052
PCT Pub. Date: Dec. 30, 2015

(65) Prior Publication Data

US 2017/0117655 A1 Apr. 27, 2017

(30) Foreign Application Priority Data

Jun. 25, 2014 (DE) ..... 10 2014 108 847

(51) Int. Cl.
*H01R 13/42* (2006.01)

(52) U.S. Cl.
CPC ..... *H01R 13/42* (2013.01)

(58) Field of Classification Search
CPC .... H01R 9/034; H01R 13/652; H01R 13/655; H01R 13/65802; H01R 13/6591; H01R 13/648; H01R 13/6594; H01R 13/6595; H01R 13/6596
See application file for complete search history.

(56) References Cited

U.S. PATENT DOCUMENTS

| | | | | |
|---|---|---|---|---|
| 6,004,162 | A | 12/1999 | Harting et al. | 439/701 |
| 7,717,732 | B2 | 5/2010 | Busse et al. | 439/404 |
| 7,874,849 | B2 | 1/2011 | Sticker et al. | 439/76.1 |

(Continued)

FOREIGN PATENT DOCUMENTS

| | | | |
|---|---|---|---|
| CN | 202454831 | 9/2012 | H01R 13/02 |
| DE | 296 01 998 | 4/1996 | H01R 13/514 |
| DE | 197 07 120 | 6/1998 | H01R 13/514 |

(Continued)

OTHER PUBLICATIONS

International Preliminary Report on Patentability issued in application No. PCT/DE2015/100253, dated Jan. 5, 2017 (8 pgs).

(Continued)

*Primary Examiner* — Ross Gushi
(74) *Attorney, Agent, or Firm* — Hayes Soloway P.C.

(57) ABSTRACT

Provided is a plug connector module for inserting in a holding frame of a modular plug connector. The plug connector module is provided so as to make electrical contact with the holding frame. A housing that forms the plug connector module is embodied from metal and can be connected in a mechanical and electrically conductive manner by way of a first type of fastener and a second type of fastening means to the holding frame.

27 Claims, 4 Drawing Sheets

(56) References Cited

U.S. PATENT DOCUMENTS

2014/0315403 A1* 10/2014 Han ..... H01R 13/6597
439/159

FOREIGN PATENT DOCUMENTS

| | | | |
|---|---|---|---|
| DE | 10 2013 108 383 | 2/2015 | ..... H01R 13/514 |
| EP | 0 860 906 | 8/1998 | ..... H01R 13/518 |
| EP | 2 312 700 | 4/2011 | ..... H01R 13/518 |
| RU | 2322740 | 4/2008 | ..... H01R 12/22 |
| RU | 2365004 | 8/2009 | ..... H01R 9/24 |
| RU | 2395880 | 7/2010 | ..... H01R 13/62 |

OTHER PUBLICATIONS

International Search Report issued in corresponding PCT Patent Appln. PCT/DE2015/100253, dated Sep. 22, 2015, with English translation (5 pgs).
German Office Action issued in corresponding German Patent Appln. 10 2014 108 847.6, dated Jun. 10, 2015 (1 pg).
Chinese Office Action issued in application No. 201580002119.5, dated Apr. 12, 2017 (7 pgs).
Russian Decision to Grant and Search Report (w/translation) issued in application No. 2016106361/07, dated Mar. 30, 2017 (18 pgs).

* cited by examiner

PLUG CONNECTOR MODULE

BACKGROUND OF THE INVENTION

The invention relates to a plug connector modules for constructing modular plug connectors. Multiple, similar or diverse plug connector modules are combined into one plug connector. The plug connector can thus be formed and configured with a high degree of flexibility.

Plug connector modules are either inserted directly in a plug connector housing or inserted and fixed initially in a so-called modular frame. The modular frame is then mounted in the plug connector housing with the plug connector modules that are received in the said modular frame.

A plurality of plug connector modules for modular plug connectors are already known from the prior art. Said plug connector modules vary in their size, number of contact means that are received, dimensions of the contact means and type of contact means. Depending upon the embodiment of the plug connector module, said plug connector module can be used to transmit for example signals and currents of a digital, analogue, electrical, pneumatic, optical or hydraulic nature.

DISCUSSION OF THE PRIOR ART

DE 296 01 998 U1 discloses a modular plug connector having a metal holding frame and multiple individual modules in which contact elements are received. The holding frame is provided on one side with a connection to ground, said connection being connected by means of a metal, comb-shaped connecting bracket to contact elements in the individual modules. An electrical connection between the ground contacts of individual modules to the holding frame is thus possible.

DE 10 2013 108 383 A1 discloses an electrical plug connector module that is provided alone or in combination with further plug connector modules for forming a modular plug connector. The electrical plug connector module can be inserted depending upon the embodiment directly in a plug connector housing or can be fastened received in a holding frame having further modules in a plug connector housing. The electrical plug connector module comprises an electrical contact means that is connected in the interior of the electrical plug connector module in an electrically conductive manner to an electrical contact that is received in the interior of the electrical plug connector module. The electrical contact means that is guided on the outer side of the electrical plug connector module in addition makes contact with the holding frame or the plug connector housing by way of a resilient region and the electrical plug connector module is inserted into said housing.

EP 0 860 906 B1 discloses a holding frame for holding plug connector modules and for integrating into a plug connector housing or for screwing on to wall surfaces, wherein the plug connector modules are inserted into the holding frame and holding means on the plug connector modules cooperate with recesses that are provided on opposite-lying wall parts (side parts) of the holding frame. The recesses are embodied on all sides as closed openings in the side parts of the holding frame and the holding frame is embodied from two halves that are connected to one another in an articulated manner.

It is disadvantageous in the case of the solutions that are known from the prior art for modular plug connectors that it is only possible to establish a contact and provide a connection to an electrical ground in a manner that is limited with respect to the dimensions of the cross section.

The fastenings that are provided on the holding frames for a connection to ground are mainly only designed in dependence upon the type of construction for a conductor cross section of up to 10 $mm^2$. The use of ground contact elements in plug connector modules is also regulated by means of the connection to the ground connection on the holding frame. A secure electrical connection of the ground contact to the holding frame is not possible.

OBJECT OF THE INVENTION

The object of the invention is to embody a plug connector module in such a manner that an electrical contact is secured between the electrical contact element and a holding frame in which the plug connector module is inserted, is also ensured in the case of very large conductor cross sections. Known holding frames that are not designed for large conductor cross sections of this type are furthermore to be used.

SUMMARY OF THE INVENTION

The invention is an electrical plug connector module for use in a metal holding frame. The plug connector module is embodied from a housing and at least one electrical contact element that is received in the housing.

The housing forms a plugging side for making contact with a complementing plug connector module, a connecting side for connecting an electrical conductor to the contact element and two fastening sides to which it is possible to fasten the plug connector module with in the holding frame. For this purpose, fastening means are expediently provided on the fastening sides, said fastening means cooperating with corresponding fastening means on the holding frame.

The electrical contact element is arranged in the housing in such a manner that said contact element reaches with a connecting end into the connecting side of the plug connector module and reaches with a plugging end into the plugging side of the plug connector module. The connection of an electrical conductor on the connecting end of the electrical contact element on the connecting side of the plug connector module is thus possible and contact is made with a corresponding plug connector module by way of the plugging side.

In order to ensure a secure electrical connection to ground between the contact element and holding frame, the housing is embodied in accordance with the invention from an electrically conductive material. The connection to ground can then be transferred by way of the housing to the holding frame by means of making direct contact between the contact element and the housing. In a preferred embodiment, the housing is embodied from metal.

In a preferred embodiment, two types of fastening means are provided on at least one of the fastening sides of the housing. One fastening means of the first type and one fastening means of the second type. The fastening means of the first and second type can be arranged in such a manner that is variable in relation to location with respect to one another.

In other words, the fastening means of the first type is provided in a rigid manner on the housing, while the fastening means of the second type is provided in a movable manner on the housing and can be fixed on the housing by means of for example a screw. As a consequence, it is rendered possible to clamp components between the fastening means. The holding frame, in which the plug connector module is inserted, can thus be mechanically fixed between the fastening means of the first and second type. A secure electrical contact arrangement can thus be ensured.

In a further preferred embodiment, the housing is embodied in a two-part manner from two housing parts. A simplified assembly of the contact elements in the housing is rendered possible by means of the two-part embodiment of the housing. In addition, it is possible by means of a two-part housing to clamp the contact element in the housing. This increases the contact reliability between the contact element and the housing in comparison to contact elements that otherwise are only latched in the housing.

In a particularly advantageous embodiment, the housing parts are embodied in a hermaphroditic manner. As a consequence, it is possible to form a housing from two identical housing parts. This saves on storage and production costs.

In order to ensure a particularly good, electrical conductivity between the plug connector module and the holding frame, a further, expedient embodiment provides that all components of the plug connector module are produced from a conductive material, preferably metal. As high as possible an electrical conductivity is rendered possible by means of using metal connecting components such as screws, rivets or washers.

BRIEF DESCRIPTION OF THE DRAWINGS

An exemplary embodiment of the invention is illustrated in the drawings and is further explained hereinunder. In the drawings.

DETAILED DESCRIPTION OF THE INVENTION

Figure 1:
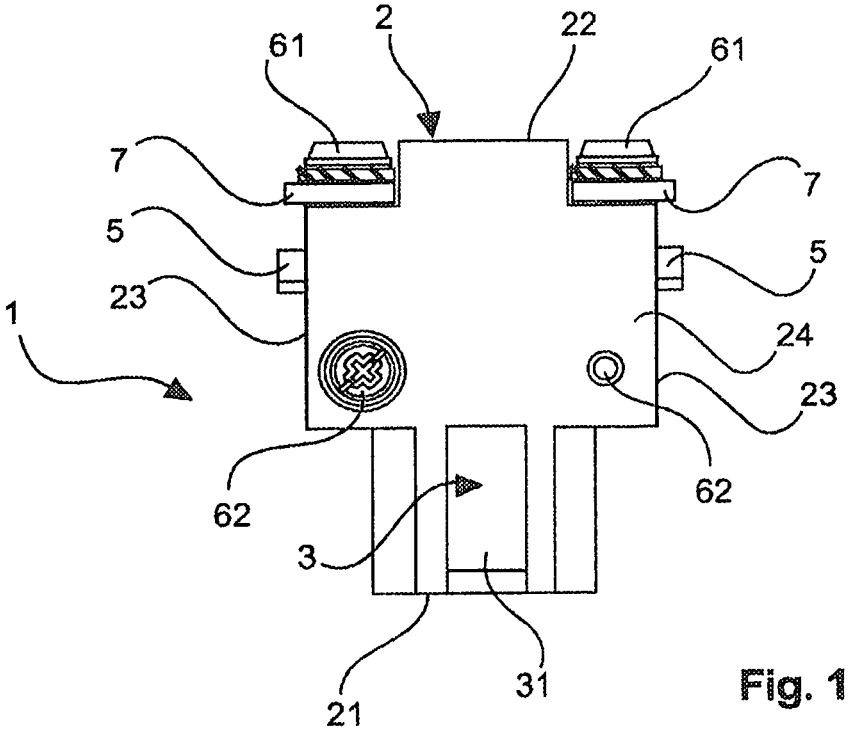
FIG. 1 illustrates a plug connector module in a front view

The figures include in part, simplified, schematic illustrations. In part, identical reference numerals are used for like but where necessary not identical elements. Various views of identical elements could be represented on a different scale.

FIG. 1 illustrates an electrical plug connector module 1 in accordance with the invention in a front view. The plug connector module 1 is formed from a housing 2 and a contact element 3 that is received in the housing 2. The housing 2 comprises two housing parts 24 that lie one behind the other in this case. The housing parts 24 are mechanically connected to one another using two screws 62 that are in each case screwed in from one side.

As is illustrated in the upper region of FIG. 1, the plug connector module 1 forms a connecting side 22. Opposite said connecting side, the plug connector module 1 forms a plugging side 21 that is illustrated in the lower region. The plugging side 21 is provided so as to establish contact with a corresponding plug connector module. The contact element 3 protrudes into the plugging side 21 and forms a plugging end 31 at that location.

A cable that is to be connected can be inserted into the plug connector module 1 on the connecting side 22 and said cable can be connected to a provided connecting end 32 of the electrical contact element 3.

Two fastening sides 23 are located on the sides of the plug connector module 1. Said fastening sides are used so as to fasten the plug connector module 1 in a holding frame 8. Two types of fastening means are provided for this purpose on the fastening sides 23. The fastening means of the first type 5 that are fixed in a rigid manner on the housing 2. In this exemplary embodiment, the fastening means of the first type 5 are integrated into the housing parts 24 in a single-part manner.

The fastening means of the second type 7 is arranged above this, said fastening means of the second type being connected by means of screws 61 to the housing 2. By virtue of the fact that the fastening means of the second type 7 is attached to the plug connector module 1 in such a manner that it can move, but the fastening means of the first type 5 is not, a movement of the fastening means of the first type 5 and the fastening means of the second type 7 can be performed relative to one another. This movement renders it possible to clamp components between the fastening means of the first and second type 5/7.

Figure 2:
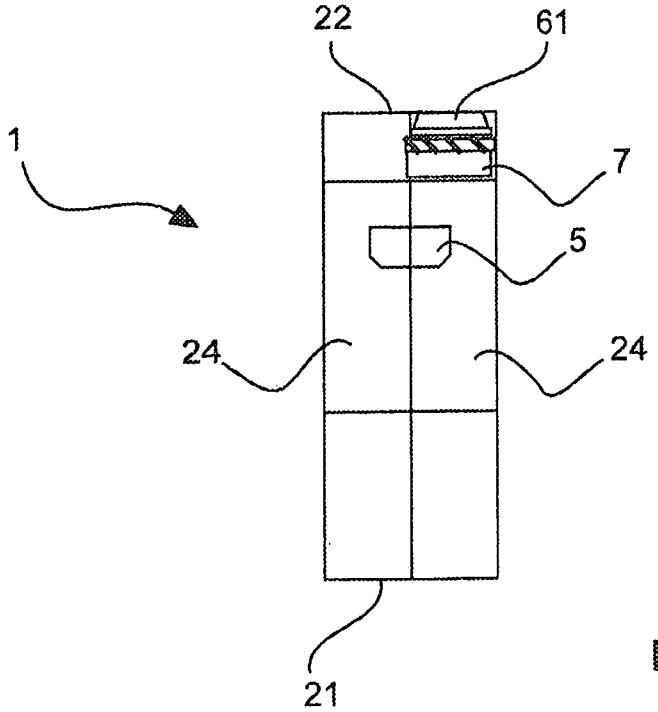
FIG. 2 illustrates a plug connector module in a side view

FIG. 2 illustrates a plug connector module 1 from a side view with a view of the fastening side 23. The two housing parts 24 that form the housing 2 are evident. The fastening means of the first type 5 is divided in two. In each case, one half is formed on a housing part 24.

The fastening means of the second type 7 on the other hand is fastened on merely one housing part 24. A thread is provided for this purpose in the housing part 24 and the screw 61 is screwed into said thread and the fastening means of the second type 7 is thus fixed. In addition, a retaining ring is provided between the screw head and fastening means of the second type 7 so as to secure the fastening means of the second type 7 and the screw 61.

Figure 3:
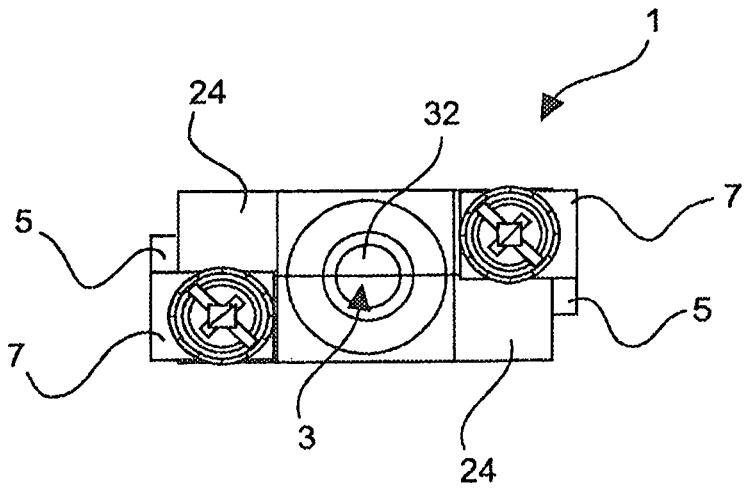
FIG. 3 illustrates a plug connector module in a plan view
Figure 4:
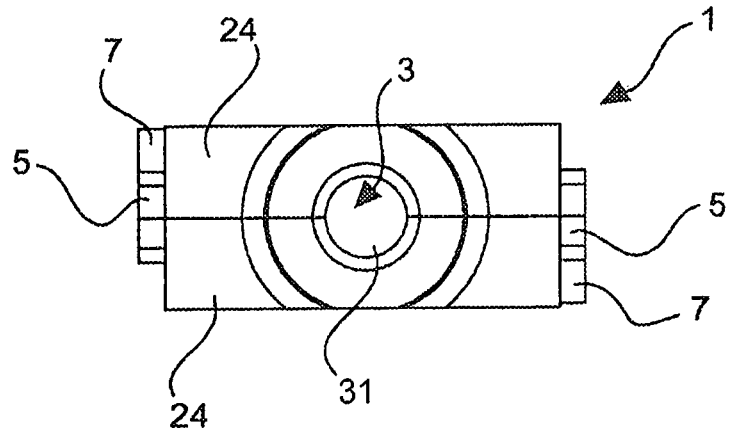
FIG. 4 illustrates a plug connector module in a further view

FIG. 3 and FIG. 4 illustrate in each case a further view of a plug connector module 1 in a plan view of the connecting side 22 in FIG. 3 and with a view of the plugging side 21 in FIG. 4. In FIG. 3, the contact element 3 is evident with a view of a connecting region 32. Said contact element can be accessed by way of the connecting side 22 of the plug connector module 1 and can thus be connected to an electrical cable that is to be connected. In FIG. 4, a plugging region 31 of the contact element 3 is evident, said plugging region being provided so as to make an electrical contact with a corresponding plug connector module 1.

Figure 5:
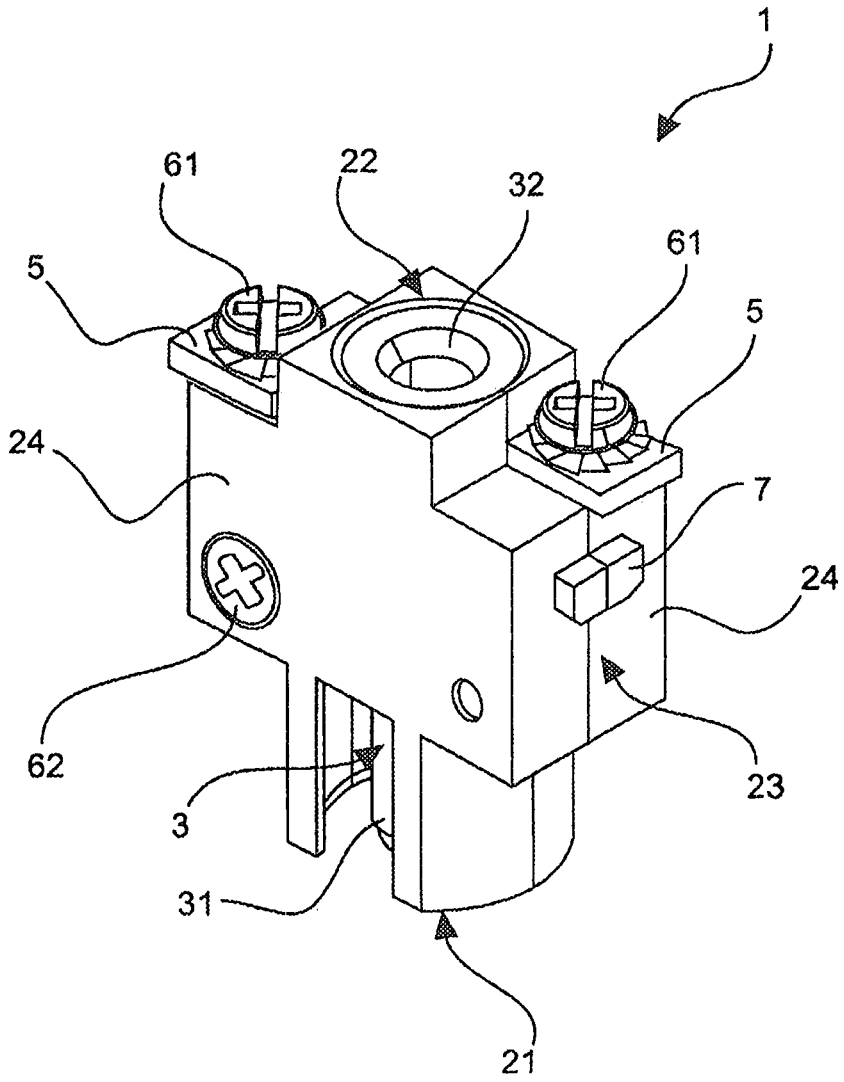
FIG. 5 illustrates a plug connector module in a spatial illustration.

The plug connector module 1 from FIGS. 1 to 4 is illustrated in FIG. 5 in a spatial view.

Figure 6:
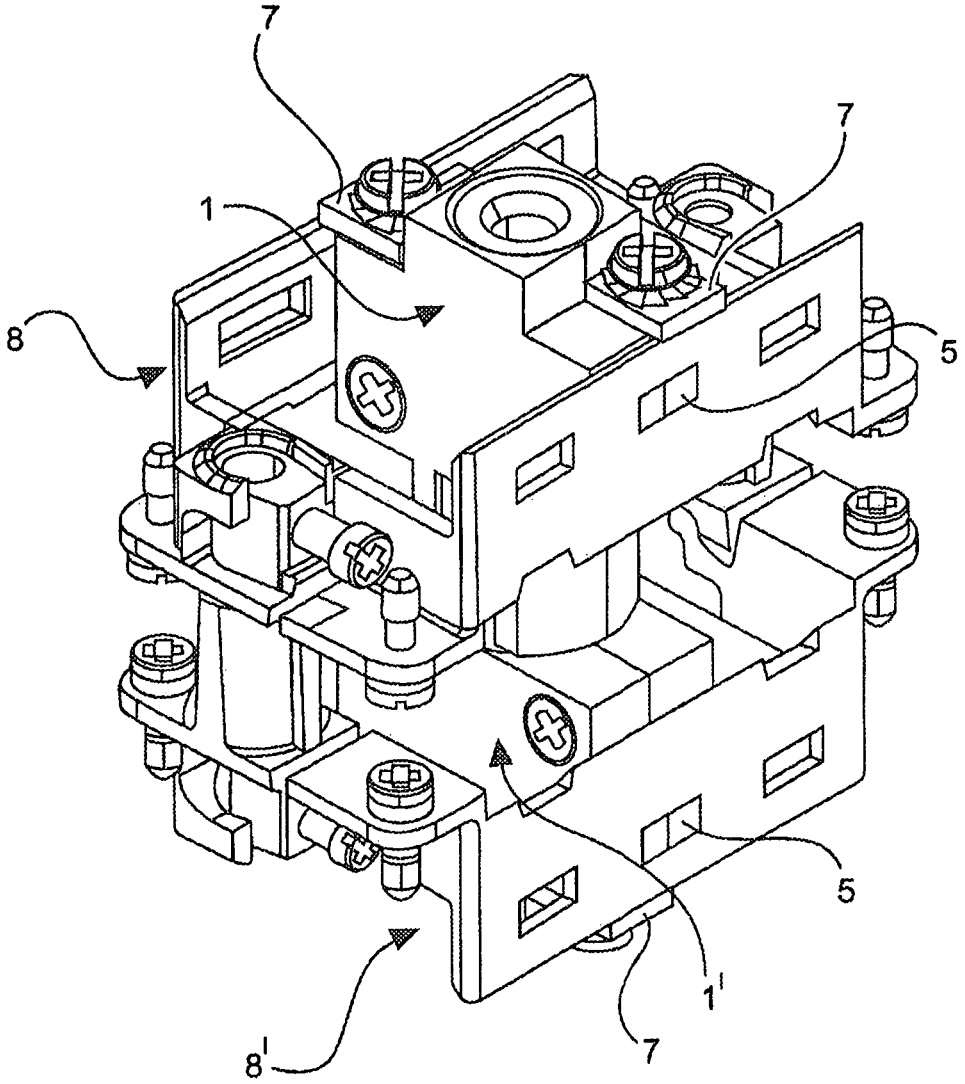
FIG. 6 illustrates two plug connector modules in a holding frame.

FIG. 6 illustrates two corresponding plug connector modules 1, 1' in accordance with FIGS. 1 to 5, said plug connector modules being received in a holding frame 8, 8'. The holding frame 8, 8' and the plug connector modules 1, 1' are connected to one another.

The fastening means of the first type 5 of the plug connector modules 1 are evident, said fastening means engaging in a positive-locking manner in recesses of the holding frame 8, 8'. In addition, the fastening means of the second type 7 are screwed onto the plug connector modules 1, 1' and thus clamp a region of the holding frame 8, 8' between the fastening means of the first and the second type 5, 7. A secure, mechanical fixing arrangement of the plug connector modules 1, 1' on the holding frame 8, 8' is thus ensured. A secure and permanent electrical connection can thus be ensured.

The invention claimed is:

1. An electrical plug connector module having a housing and at least one electrical contact element, wherein the housing forms a plugging side, a connecting side and two fastening sides, wherein the fastening sides each comprise an integrated fastener, wherein at least one of the fastening sides comprises a fastener of a first type and a fastener of a second type, wherein the fastener of the second type can be fixed in each case using at least one screw on the housing, wherein the contact element is received in the one housing, and wherein the contact element can be accessed from the plugging side and the connecting side, wherein the housing is formed from an electrically conductive material and is in electrically conductive contact with the contact element.

2. The electrical plug connector module as claimed in claim 1 wherein the fastener of the first type and fastener of the second type are provided on the at least one fastening side in such a manner that they can move with respect to one another.

3. The electrical plug connector module as claimed in claim 2 wherein the fastener of the first type is provided in a rigid manner on the housing and the fastener of the second type is provided in such a manner that it can move on the housing.

4. The electrical plug connector module as claimed in claim 1 wherein the housing is forming from at least two housing parts.

5. The electrical plug connector module as claimed in claim 4 wherein the two housing parts that form the housing are embodied in a hermaphroditic manner.

6. The electrical plug connector module as claimed in claim 1 wherein the housing is embodied from metal.

7. The electrical plug connector module as claimed in claim 1 wherein all parts of the electrical plug connector module are formed in an electrically conductive manner.

8. The electrical plug connector module as claimed in claim 7 wherein all the parts of the electrical plug connector module are formed from metal.

9. An electrical plug connector module having a housing and at least one electrical contact element, wherein the housing forms a plugging side, a connecting side and two fastening sides, wherein the fastening sides comprise in each case at least one fastener, and at least one of the fastening sides comprises a fastener of a first type and a fastener of a second type, wherein the fastener of the first type and fastener of the second type are provided on the at least one fastening side in such a manner that they can move with respect to one another, the fastener of the first type is provided in a rigid manner on the housing and the fastener of the second type is provided in such a manner that it can move on the housing, and the fastener of the second type can be fixed in each case using at least one screw on the housing, wherein the contact element is received in the one housing, wherein the contact element can be accessed from the plugging side and the connecting side, and wherein the housing is formed from an electrically conductive material and is in electrically conductive contact with the contact element.

10. The electrical plug connector module as claimed in claim 1 wherein the housing is formed from at least two housing parts.

11. The electrical plug connector module as claimed in claim 10 wherein the two housing parts that form the housing are embodied in a hermaphroditic manner.

12. The electrical plug connector module as claimed in claim 9, wherein the housing is embodied from metal.

13. The electrical plug connector module as claimed in claim 9, wherein all parts of the electrical plug connector module are formed in an electrically conductive manner.

14. The electrical plug connector module as claimed in claim 13 wherein all the parts of the electrical plug connector module are formed from metal.

15. An electrical plug connector module having a housing formed of at least two housing parts, embodied in a hermophrodic manner, and at least one electrical contact element, wherein the housing forms a plugging side, a connecting side and two fastening sides, wherein the fastening sides comprise in each case at least one fastener, wherein the contact element is received in the one housing, wherein the contact element can be accessed from the plugging side and the connecting side, and wherein the housing is formed from an electrically conductive material and is in electrically conductive contact with the contact element.

16. The electrical plug connector module as claimed in claim 15, wherein at least one of the fastening sides comprises a fastener of the first type and a fastener of the second type.

17. The electrical plug connector module as claimed in claim 16, wherein the fastener of the first type and fastener of the second type are provided on the at least one fastening side in such a manner that they can move with respect to one another.

18. The electrical plug connector module as claimed in claim 17, wherein the fastener of the first type is provided in a rigid manner on the housing and the fastener of the second type is provided in such a manner that it can move on the housing.

19. The electrical plug connector module as claimed in claim 15, wherein the housing is embodied from metal.

20. The electrical plug connector module as claimed in claim 15 wherein all parts of the electrical plug connector module are formed in an electrically conductive manner.

21. The electrical plug connector module as claimed in claim 20, wherein all the parts of the electrical plug connector module are formed from metal.

22. An electrical plug connector module as claimed in claim 15, wherein all parts of the electrical plug connector module are formed in an electrically conductive manner.

23. The electrical plug connector module as claimed in claim 22 wherein at least one of the fastening sides comprises a fastener of a first type and a fastener of a second type.

24. The electrical plug connector module as claimed in claim 23 wherein the fastener of the first type and fastener of the second type are provided on the at least one fastening side in such a manner that they can move with respect to one another.

25. The electrical plug connector module as claimed in claim 24, wherein the fastener of the first type is provided in a rigid manner on the housing and the fastener of the second type is provided in such a manner that it can move on the housing.

26. The electrical plug connector module as claimed in claim 22 wherein the housing is formed from at least two housing parts.

27. The electrical plug connector module as claimed in claim 22, wherein all the parts of the electrical plug connector module are formed from metal.

* * * * *